US007358670B2

(12) United States Patent
Kang

(10) Patent No.: US 7,358,670 B2
(45) Date of Patent: Apr. 15, 2008

(54) PLASMA DISPLAY PANEL DESIGN WITH MINIMAL LIGHT OBSTRUCTING ELEMENTS

(75) Inventor: Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 322 days.

(21) Appl. No.: 11/135,494

(22) Filed: May 24, 2005

(65) Prior Publication Data

US 2005/0264201 A1 Dec. 1, 2005

(30) Foreign Application Priority Data

May 31, 2004 (KR) ..... 10-2004-0039254

(51) Int. Cl.
*H01J 17/49* (2006.01)

(52) U.S. Cl. ..... 313/582; 313/584

(58) Field of Classification Search ..... 313/582–587
See application file for complete search history.

(56) References Cited

U.S. PATENT DOCUMENTS 5,107,182 A * 4/1992 Sano et al. ..... 315/169.4
5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
RE37,444 E 11/2001 Kanazawa
6,570,339 B1 * 5/2003 Moore ..... 315/169.3
6,630,916 B1 10/2003 Shinoda
6,707,436 B2 3/2004 Setoguchi et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
(74) *Attorney, Agent, or Firm*—Robert E. Bushnell, Esq.

(57) ABSTRACT

Provided is a plasma display panel (PDP) design that results in improved light emission efficiency and improved brightness and improved opening ratio. The PDP includes a transparent upper substrate, a lower substrate oriented parallel to the upper substrate, a first discharge electrode extending in a first direction on the lower substrate, a dielectric layer that covers the first discharge electrode, a plurality of barrier ribs made of a dielectric material between the upper and lower substrates dividing a space between the upper and the lower substrate into a plurality of discharge cells, a second discharge electrode within the barrier ribs and extending in a second direction to cross the first discharge electrode, a phosphor layer located within the discharge cell, and a discharge gas located within the discharge cell.

20 Claims, 9 Drawing Sheets

U.S. PATENT DOCUMENTS 7,015,643 B2 * 3/2006 Kweon ..... 313/583

FOREIGN PATENT DOCUMENTS

| | | |
|---|---|---|
| JP | 10-1724452 | 6/1998 |
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL DESIGN WITH MINIMAL LIGHT OBSTRUCTING ELEMENTS

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 31 May 2004 and there duly assigned Serial No. 10-2004-0039254.

BACKGROUND OF THE INVENTION

1. Field of the Invention

The present invention relates to a novel plasma display panel (PDP) design having improved opening ratio, brightness and light emission efficiency.

2. Description of the Related Art

PDPs have two substrates, one being transparent. Between the two substrates are the discharge cells containing fluorescent material and a discharge gas. Ultraviolet light generated in the plasma between the two substrates is converted into visible light by the fluorescent material. This visible light must then travel through one of the two substrates to be viewed. However, in order to generate the plasma, electrodes formed on the substrates produce a potential difference that generates the plasma. Unfortunately, the electrodes are formed on the substrate and thus in the path through which the visible light travels. These electrodes contain a narrow but opaque conductive portion and a wide but semi transparent indium tin oxide (ITO) portion. In addition these electrode portions, the visible light must pass through a dielectric layer and a protective layer to be viewed. All of these elements lead to an absorption of about 40% of the visible light that tries to reach the viewer by traveling through a substrate with a limited opening ratio. What is needed is an improved design for a PDP that cuts down in the amount of visible light that is absorbed and improves upon the opening ratio.

SUMMARY OF THE INVENTION

It is therefore an object of the present invention to provide an improved design for a PDP.

It is also an object of the present invention to provide a design for a that allows for nearly all of the visible light produced by the phosphor layers to be viewed by a viewer.

It is yet an object of the present invention to provide a design for a PDP that has fewer light-obstructing elements on the transparent substrate through which the visible image is viewed.

It is still an object of the present invention to provide a design for a PDP that improves upon the opening ratio.

It is further an object of the present invention to provide a design for a PDP that provides improved brightness and improved light emission efficiency.

These and other objects may be achieved by a PDP that includes a transparent upper substrate, a lower substrate located and oriented parallel to the upper substrate, a first discharge electrode formed on the lower substrate and extending in a first direction, a dielectric layer that covers the first discharge electrode, a plurality of barrier ribs made of a dielectric material dividing a space between the upper substrate and the lower substrate into a plurality of discharge cells, a second discharge electrode located within the barrier ribs and extending in a second and different direction and crossing the first discharge electrode, phosphor layers located within the discharge cells and a discharge gas located within the discharge cells.

The barrier ribs can include upper barrier ribs formed on a lower surface of the upper substrate and having the second discharge electrode formed within and lower barrier ribs formed on the dielectric layer, the phosphor layer being located on the sidewalls of the lower barrier ribs and on the dielectric layer. The second discharge electrodes can have a ladder shape. Also, the second discharge electrodes can be parallel to each other and spaced apart from each other by a predetermined distance. The second discharge electrodes are designed to cover essentially an entire surface of the PDP on which discharge cells are arranged. The lower barrier ribs and the upper barrier ribs preferably each having identical patterns and each having a closed pattern. The first discharge electrode can be extended in a length direction of the discharge cell and extend underneath centers of discharge cells.

The phosphor layer can be formed on a lower surface of the upper substrate and against a portion of the upper barrier ribs above the second discharge electrode. Instead, the phosphor layer can be formed on the dielectric layer and against the lower barrier ribs below the discharge cells. Alternatively, the phosphor layer can be formed both above and below the second discharge electrode. On the side surface of the barrier rib, a portion that is not covered by the phosphor layer can be covered by an MgO protective film.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
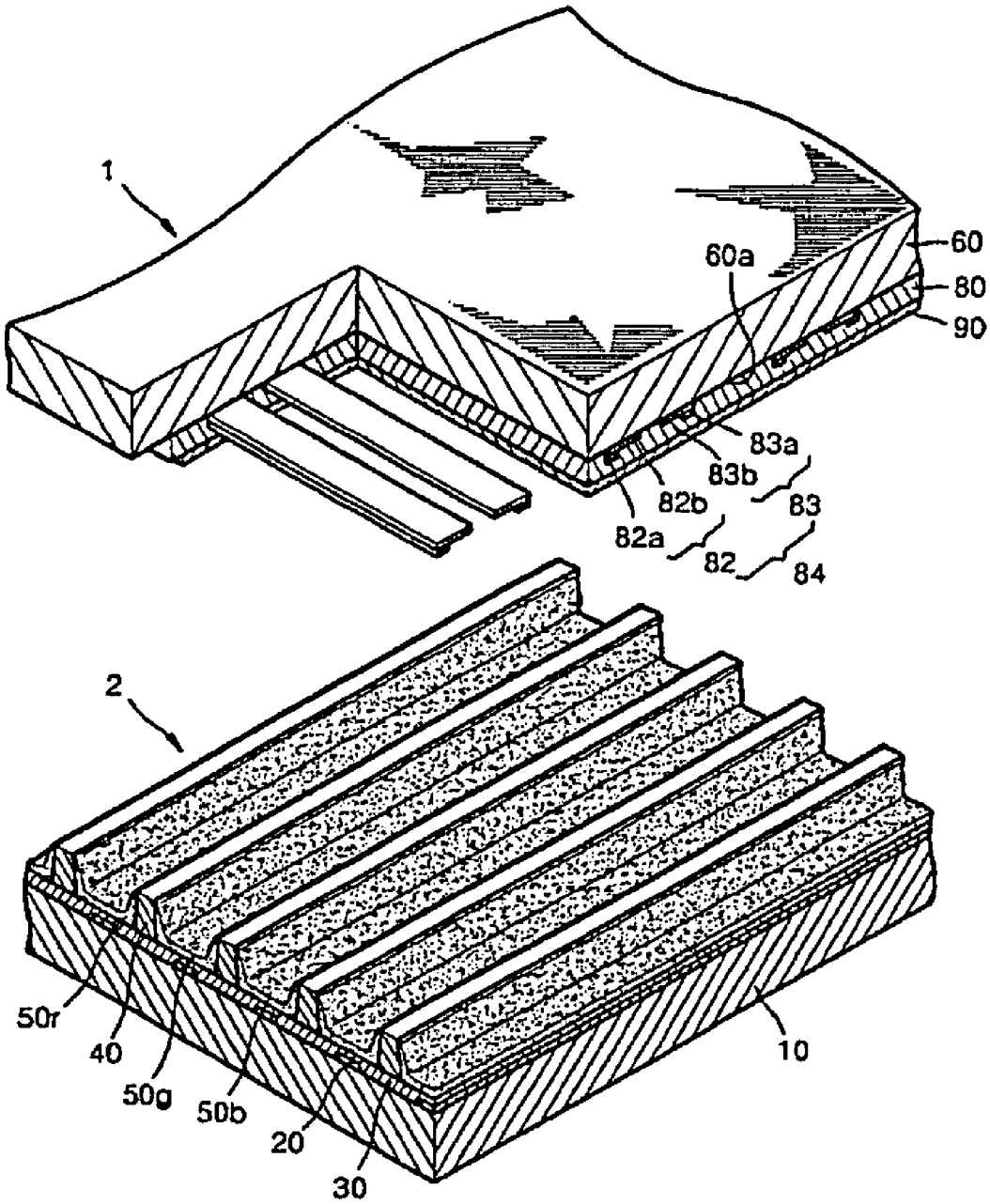
FIG. 1 is a cutaway exploded perspective view of a PDP.

Turning now to the figures, FIG. 1 is a cutaway exploded perspective view of a PDP 110 similar to that disclosed in Japanese Patent Laid-Open publication 1998-172442. Referring to FIG. 1, PDP 110 has an upper panel 1 that is coupled with a lower panel 2, and a discharge gas that is filled in a space defined by the upper panel 1 and the lower panel 2. The upper panel 1 includes an upper substrate 60, a sustain electrode pair 84 that includes an X electrode 82 and a Y electrode 83 formed on a lower surface 60*a* of the upper substrate 60 and an upper dielectric layer 80 that covers the sustain electrode pair 84. The upper dielectric layer 80 can be covered by a protection layer 90 ordinarily made of MgO. The Y electrode 83 includes a first transparent electrode 83*b* formed of ITO (Indium Tin Oxide) and a first bus electrode 83*a* that serves to reduce the voltage drop along the first transparent electrode 83*b*. Similarly, the X electrode 82 also includes a second transparent electrode 82*b* and a second bus electrode 82*a*.

The lower panel 2 includes a lower substrate 10, address electrodes 20 formed on an upper surface of the lower substrate 10 and extending in a direction that crosses or intersects with the sustain electrode pair 84. A lower dielectric layer 30 covers the address electrodes 20. Barrier ribs 40 are formed on the lower dielectric layer 30. These barrier ribs 40 divide a space between the upper panel 1 and the lower panel 2 into a plurality of discharge cells. Phosphor layers 50*r*, 50*g*, and 50*b* of red, green and blue fluorescent material respectively are coated on an inner surface of the discharge cells.

In the PDP 110 having the above structure, a discharge cell that produces visible light is selected by the address discharge that occurs between the address electrode 20 and the Y electrode 83. Then, the selected discharge cell emits light during a sustain discharge that occurs by applying a potential difference between the X electrode 82 and the Y electrode 83 of the selected discharge cell. More specifically, the discharge gas filled within the discharge cell generates ultraviolet rays during the sustain discharge, and the ultraviolet rays excite the phosphor layers 50*r*, 50*g*, and 50*b* to thus emit visible light. The visible light emitted from the phosphor layers 50*r*, 50*g*, and 50*b* are displayed as an image for the PDP 110.

There are various factors that can increase the light emitting efficiency of the PDP 110. For example, the space for generating a sustaining discharge must be large enough to excite a discharge gas, the surface area of the phosphor layer must be wide if possible, and the elements that hinder the transmission of generated visible light through the upper panel 2 must be minimized.

However, in the PDP 110 having the above structure, a space for generating a discharge is small since a sustaining discharge occurs only in the space between the X electrode 82 and Y electrode 83 adjacent to the protection layer 90, and a large portion of the visible light emitted from the phosphor layers 50*r*, 50*g*, and 50*b* is absorbed and/or reflected by the protection layer 90, the upper dielectric layer 80, the transparent electrodes 82*b* and 83*b*, and the bus electrodes 82*a* and 83*a* before it can ever be viewed by a viewed. That is, only about 60% the visible light generated in phosphor layers 50*r*, 50*g* and 50*b* passes through the upper panel 2 to be viewed.

Figure 2:
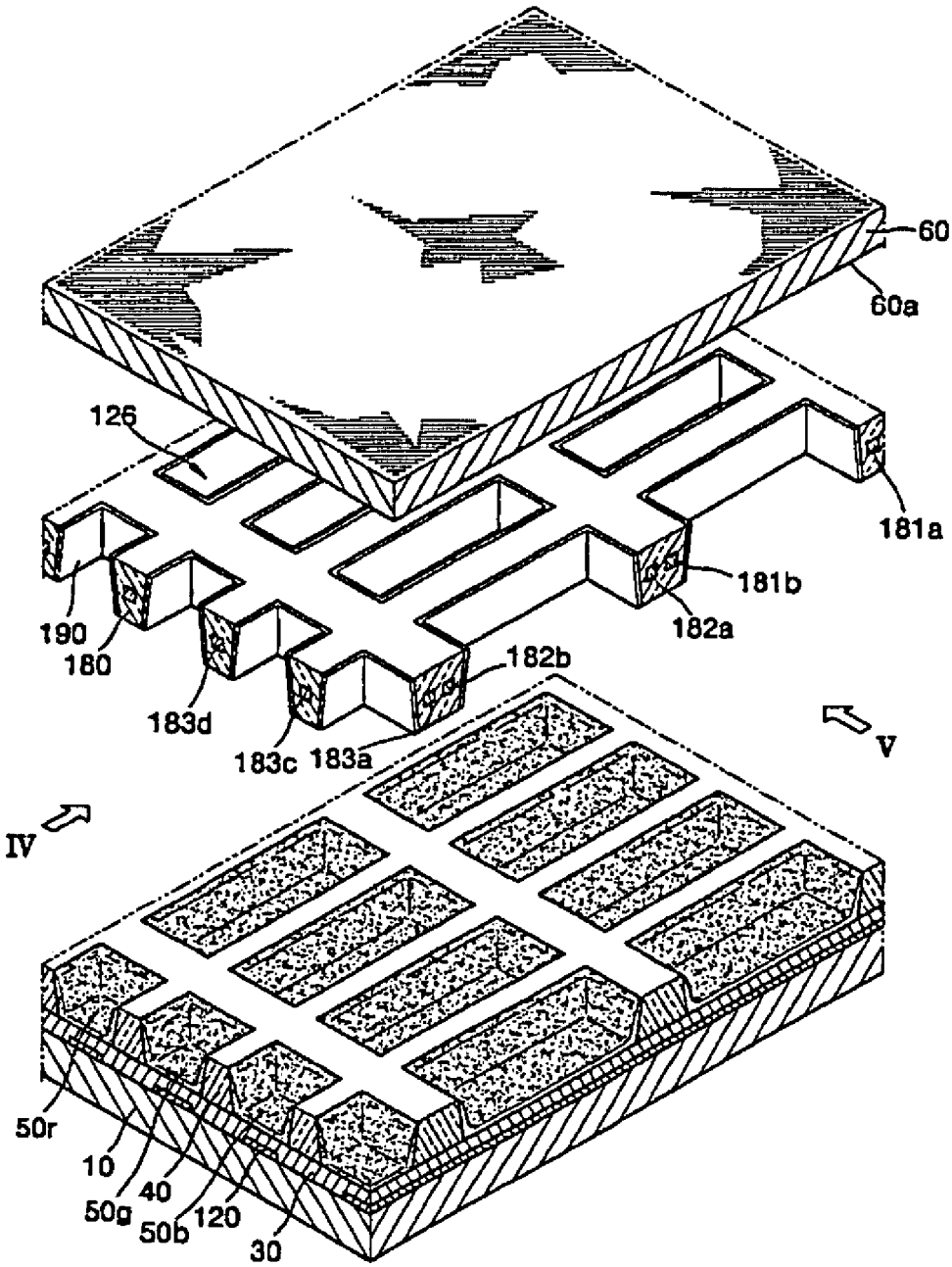
FIG. 2 is a partial exploded perspective view of a PDP according to a first embodiment of the present invention.

Turning now to FIG. 2, FIG. 2 is a partial exploded perspective view of a reflective PDP 100 according to a first embodiment of the present invention. Referring to FIG. 2, the PDP 100 includes an upper substrate 60, a lower substrate 10, a first discharge electrode 120, a dielectric layer 30, a plurality of barrier ribs, second discharge electrodes 181, 182, and 183, and phosphor layers 50*r*, 50*g*, and 50*b*.

The upper substrate 60 is made of a transparent material so that visible light generated in the discharge cells 126 can proceed through the upper substrate for viewing without being reflected or absorbed by the upper substrate 60. The lower substrate 10 is located parallel to the upper substrate 60. The first discharge electrode 120 is formed extending in a first direction (x-direction) on the lower substrate 10. The dielectric layer 30 is formed of a material having a high dielectric breakdown strength and protects the first discharge electrode 120 by covering the first discharge electrode 120. The dielectric layer 30 can be formed of a material having a high reflectance so that the visible light generated in the discharge cells 126 and traveling away from upper substrate 60 (i.e., in the −z direction) can be reflected forward so that the visible light travels towards upper substrate 60 (i.e., in the +z direction).

The second discharge electrodes 181, 182, and 183 are located in the barrier ribs and extended in a second direction (the y direction) to cross over the first discharge electrode 120. A discharge gas is filled in a space, that is, a discharge cells 126 defined by the barrier ribs.

The barrier ribs are made out of dielectric material and are located between the upper substrate 60 and the lower substrate 10, and divide a space between the upper substrate 60 and the lower substrate 10 into a plurality of discharge cells 126. Also, the barrier ribs are formed on a lower surface 60*a* of the upper substrate 60. The barrier ribs can be divided into upper barrier ribs 180 and lower barrier ribs 40. As illustrated in FIG. 2, the second discharge electrodes are located within the upper barrier ribs 180. The lower barrier ribs 40 define portions of the discharge cells 126 where the phosphor layers 50*r*, 50*g*, and 50*b* are formed. The lower barrier ribs 40 are located on the dielectric layer 30 and are closer to the lower substrate 10 than the upper barrier ribs 180. Although FIG. 2 illustrates upper barrier ribs 180 and lower barrier ribs 40 as being separate, the upper barrier ribs 180 and the lower barrier ribs 40 can instead be formed integrally as one single body and still be within the scope of the present invention.

Unlike the PDP 110 of FIG. 1, the second discharge electrodes 181, 182, and 183 in the PDP 100 of FIG. 2 do not interrupt or obstruct the path of visible light generated in the discharge cells 126 since the second discharge electrodes 181, 182, and 183 are located within the upper barrier ribs 180. In other words, by designing the second discharge electrodes 181, 182 and 183 within the upper barrier ribs 180, the second discharge electrodes are not located in the direct path of visible light that extends from the discharge cells 126 and through the upper substrate 60. Therefore, in the PDP 100 of FIG. 2, more than 80% of the visible light generated in discharge cells 126 gets transmitted through transparent upper substrate 60 to an outside of the PDP 100 where it can be viewed.

The lower barrier ribs 40 can be formed in the same pattern (a closed type pattern) as the upper barrier ribs 180. The closed type pattern is advantageous when manufacturing the upper and lower barrier ribs 180 and 40 as a single unit. However, the present invention is in no way limited to the closed type pattern as depicted in FIG. 2, but can be formed in a stripe pattern (or an open type) as illustrated in FIG. 1. The stripe pattern has the advantage of simplified exhaustion of a gas during a manufacturing process prior to filling the discharge cells with the discharge gas.

The phosphor layers 50*r*, 50*g*, and 50*b* are located in the discharge cells and generate visible light of red, green, and blue color from received ultraviolet rays produced by the sustain discharge. In particular, the phosphor layers 50*r*, 50*g*, and 50*b* are formed on side surfaces of the lower barrier ribs 40 and on an upper surface of the dielectric layer 30. Because the PDP 100 of FIG. 2 has a phosphor layers on a rear side but not on the front side of the PDP, the PDP 100 of FIG. 2 is a reflective PDP. On the side surfaces of the upper barrier ribs 180, a portion that is not covered by the phosphor layers 50*r*, 50*g*, and 50*b* is covered by a protection layer 190. The purpose of covering a portion of the barrier ribs, especially, a portion of the side surfaces of the upper barrier ribs 180 with the MgO protective layer 190 is to prevent the upper barrier ribs 180 made of a dielectric material from being directly exposed to and being bombarded by ions during the operation of the PDP 100. The MgO protective layer 190 also prevents the reduction of a discharge voltage according to the emission of secondary electrons during discharge.

Figure 3:
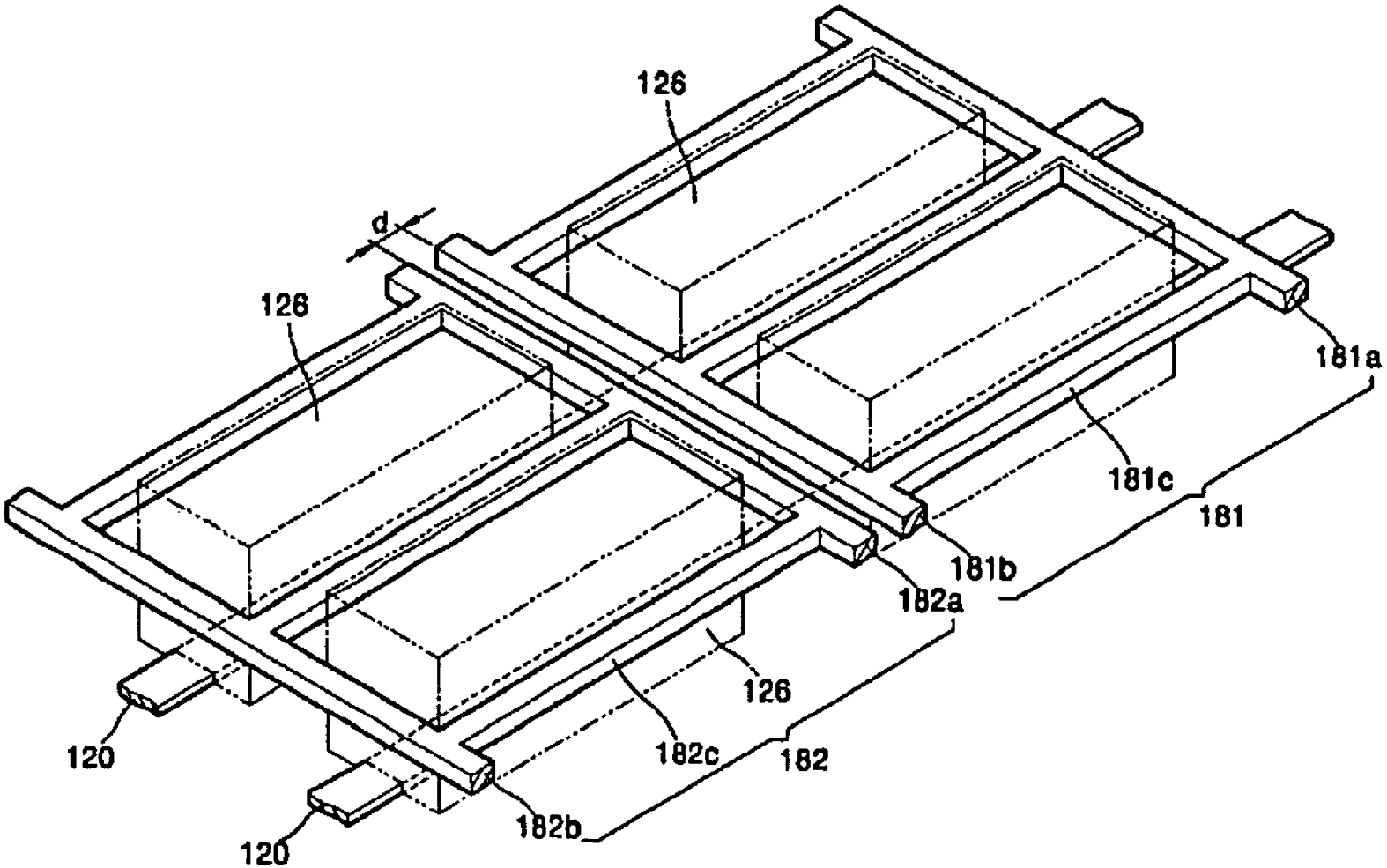
FIG. 3 is a partial perspective view of discharge electrodes included in the PDP of FIG. 2 according to a first embodiment of the present invention.

Turning now to FIG. 3, FIG. 3 is a partial perspective view of discharge electrodes included in a PDP according to an embodiment of the present invention. Referring to FIG. 3, the second discharge electrodes 181 and 182 having a ladder shape can be spaced apart from each other by a predetermined distance d and be parallel to each other on the entire surface of the PDP on which the discharge cells 126 are arranged. The shape of the second discharge electrodes 181 and 182 is not limited thereto, and the second discharge electrodes 181 and 182 can have a bar shape that is arranged parallel to each other in a length (i.e., y) direction of the second discharge electrodes 181 and 182. It is desirable that the second discharge electrodes 181, 182, and 183 surround the discharge cells 126 with a ladder shape since this configuration can increase the discharge volume.

A discharge can occur on four surfaces of the discharge cell 126 since the second discharge electrodes 181, 182, and 183 surround the discharge cell 126 with a ladder shape. Therefore, the discharge volume is increased, thus improving the brightness of the PDP.

A first discharge electrode 120 is extends in a length (i.e., x) direction under the discharge cells 126. The first discharge electrode 120 can extend underneath a center portion of the discharge cells 126 so that the discharges can occur uniformly among the portions of the second discharge electrodes 181, 182, and 183 facing each other in the discharge cells 126. The disposition of the first discharge electrode 120 is not limited in the center of the discharge cell 126, but can be shifted to the sides of the discharge cells when necessary.

Figure 4:
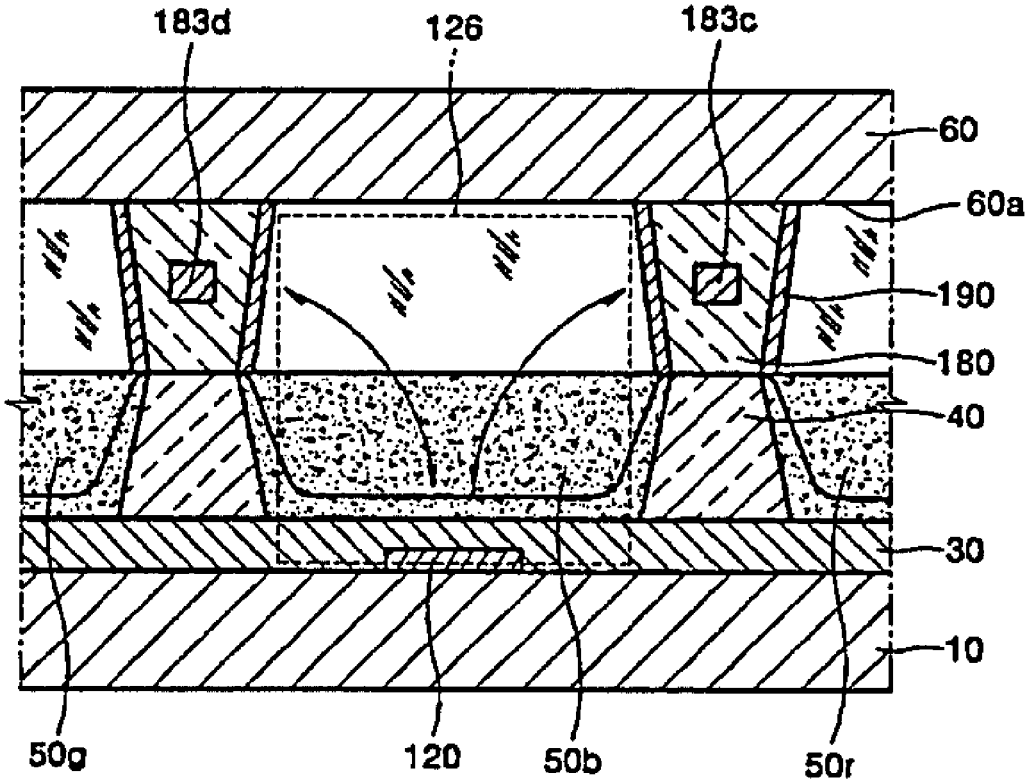
FIG. 4 is a cross-sectional view of the PDP of FIG. 2 as seen along IV-IV.
Figure 5:
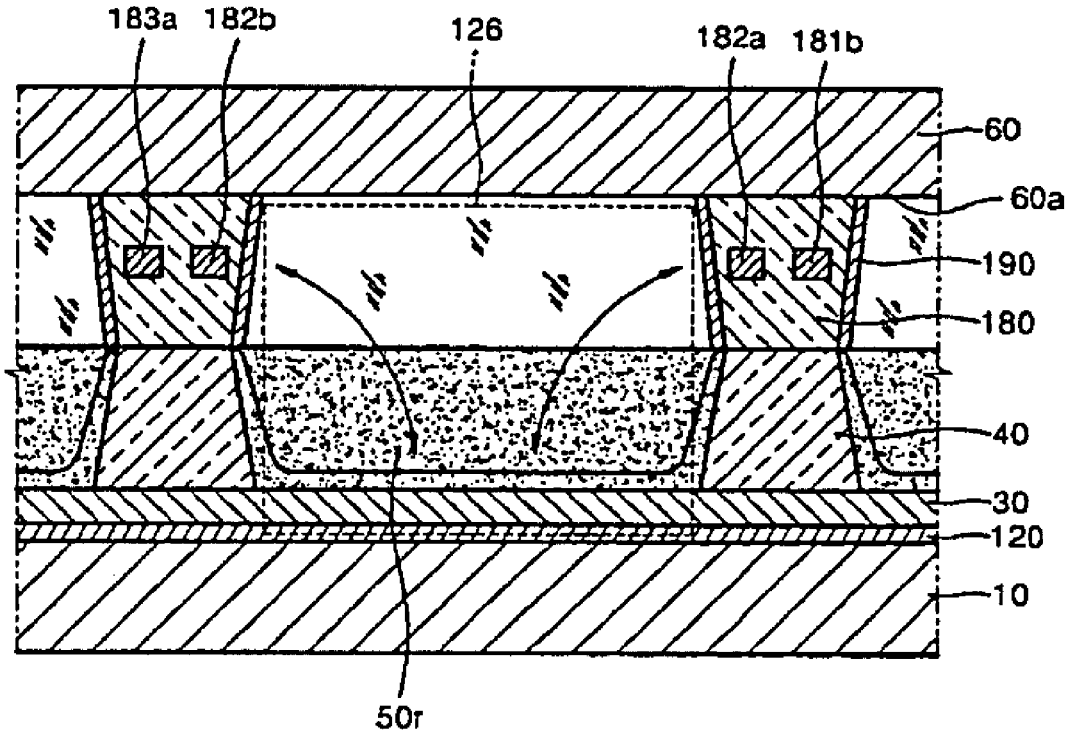
FIG. 5 is a cross-sectional view of the PDP of FIG. 2 as seen along V-V.

The operation of the PDP 100 having the above configuration according to the present invention will now be described in conjunction with FIGS. 4 and 5. FIG. 4 is a cross-sectional view of PDP 100 of FIG. 2 taken along IV-IV (i.e., in the +x direction) and FIG. 5 is a cross-sectional view of PDP 100 of FIG. 2 taken along V-V (i.e., in the +y direction). Referring to FIGS. 4 and 5, in the PDP 100, the second discharge electrodes 181, 182, and 183 perform a scanning function and a sustain discharge function, and the first discharge electrode 120 performs the address function and sustain discharge function. A discharge cells 126 in which a discharge occurs are selected by scanning signals applied to the second discharge electrodes 181, 182, and 183 and signals applied to the first discharge electrode 120. Then, a sustain discharge occurs in a direction indicated by the arrows between the first discharge electrode 120 and the second discharge electrodes 181, 182, and 183 in the discharge cells 126.

Portions 183*c* and 183*d* of the second discharge electrodes as depicted in FIG. 4 face each other and disposing spaced apart in a cross direction of the discharge cell 126 are, as it is seen in FIG. 3, portions of the second discharge electrode 183 connected to each other. A discharge does not occur between the portions 183*c* and 183*d* since an equal voltage is applied to these portions 183*c* and 183*d*. In this manner, in a single discharge cell 126, a discharge does not occur between electrodes 183*c* and 183*d* located on a position facing each other but a discharge occurs between the first discharge electrode 120 and the second discharge electrodes 183*c* and 183*d* located at 90° to each other. The breakdown voltage of this case is reduced when compared to a case when a discharge occurs between electrodes located in 180° in the three-electrode surface discharge PDP 110 of FIG. 1.

Also, according to the present invention, the second discharge electrodes 181, 182, and 183 extending in a second direction (y direction) on the upper substrate 60 are located within the upper barrier ribs 180. In the three-electrode surface discharge PDP 110 of FIG. 1, the path of visible light is obstructed by a sustain discharge electrode pair 84 located over the discharge cells. In the configuration in the present invention, the path of visible light is not interrupted by the discharge electrodes since the second discharge electrodes 181, 182 and 183 are located within upper barrier rib 180, thus improving an opening ratio and, accordingly, improving brightness.

Also, in the present invention, a discharge occurs in four directions along the barrier ribs of each unit discharge cell. Therefore, the amount of visible light generated in the PDP 100 according to the present invention is increased when compared to the three-electrode surface discharge PDP 110 of FIG. 1.

Referring to FIGS. 3 and 5, the adjacent second discharge electrodes 181, 182, and 183 are spaced apart by a predetermined distance d from each other in the same upper barrier rib 180. If the distance d is excessively small, there may be a power loss or a malfunction between adjacent second discharge electrodes as the upper barrier rib 180 is made of a dielectric material. Therefore, the second discharge electrodes 181, 182, and 183 must be spaced apart by a sufficient distance d to avoid an excessive power loss or a malfunction.

Figure 6:
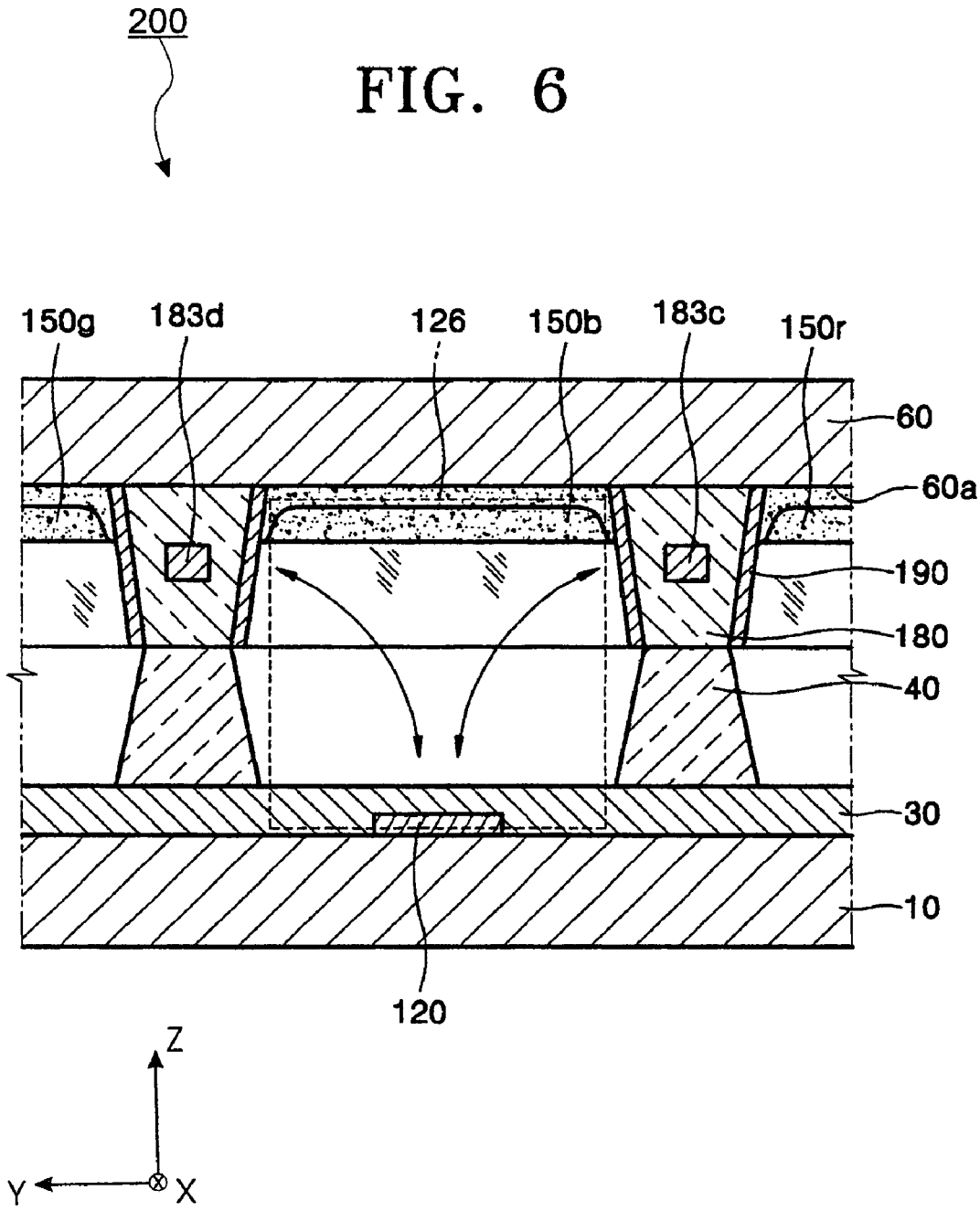
FIGS. 6 and 7 are cross-sectional views of a PDP according to a second embodiment of the present invention.
Figure 7:
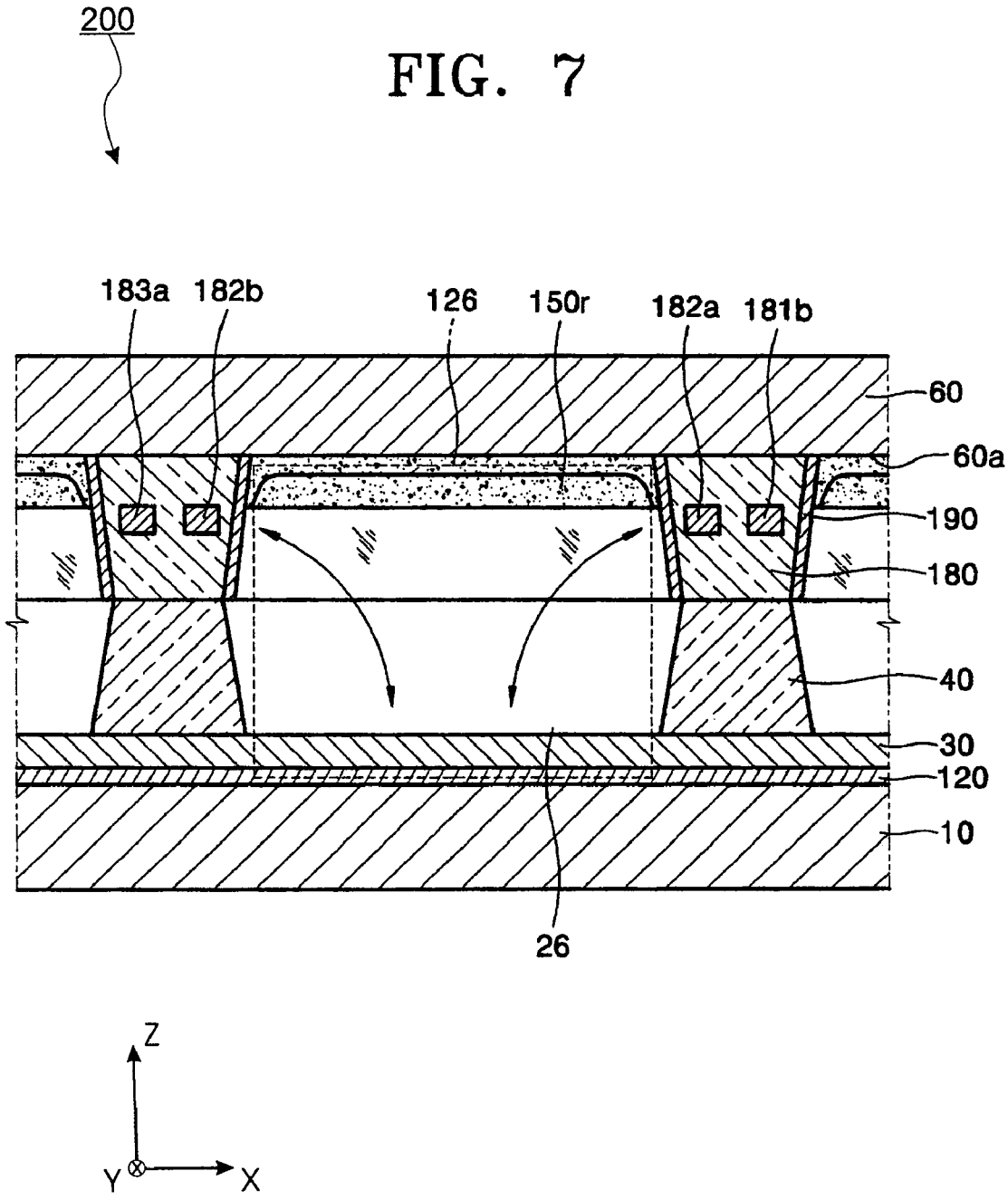

Turning now to FIGS. 6 and 7, FIGS. 6 and 7 are cross-sectional views of a PDP 200 according to a second embodiment of the present invention. Referring to FIGS. 6 and 7, phosphor layers 150*r*, 150*g*, and 150*b* can be located on a lower surface 60*a* of the upper substrate 60 and on a portion of the sidewalls of the upper barrier ribs 180. In the PDP 200 of FIGS. 6 and 7, the PDP 200 according to the second embodiment present invention is a transmissive PDP 200, because a phosphor layer is formed on the front side and not on the back side of the PDP. Unlike PDP 100 of FIGS. 2 through 5, the location of the phosphor layers are changed in PDP 200 according to the second embodiment.

Figure 8:
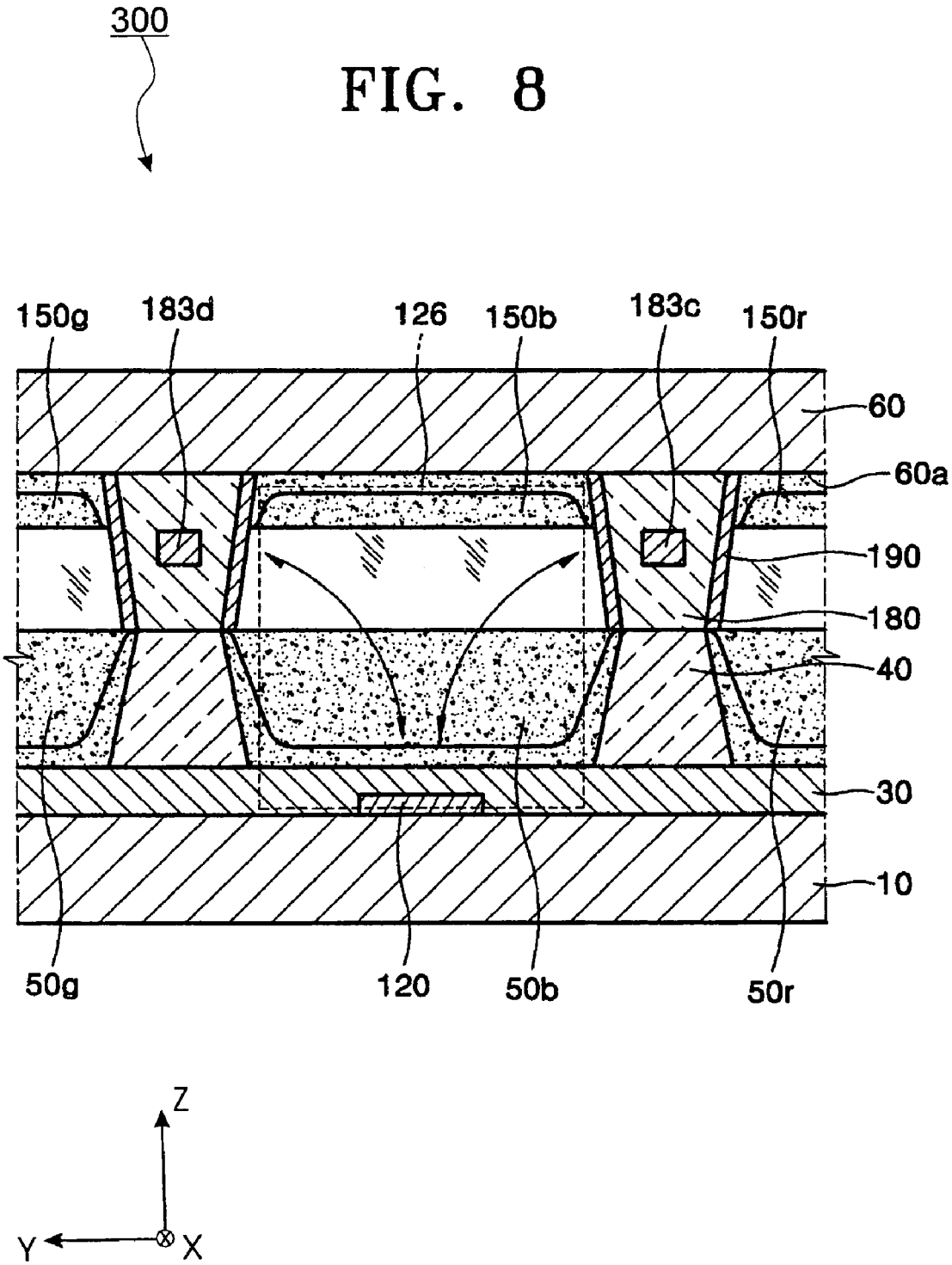
FIGS. 8 and 9 are cross-sectional views of a PDP according to a third embodiment of the present invention.
Figure 9:
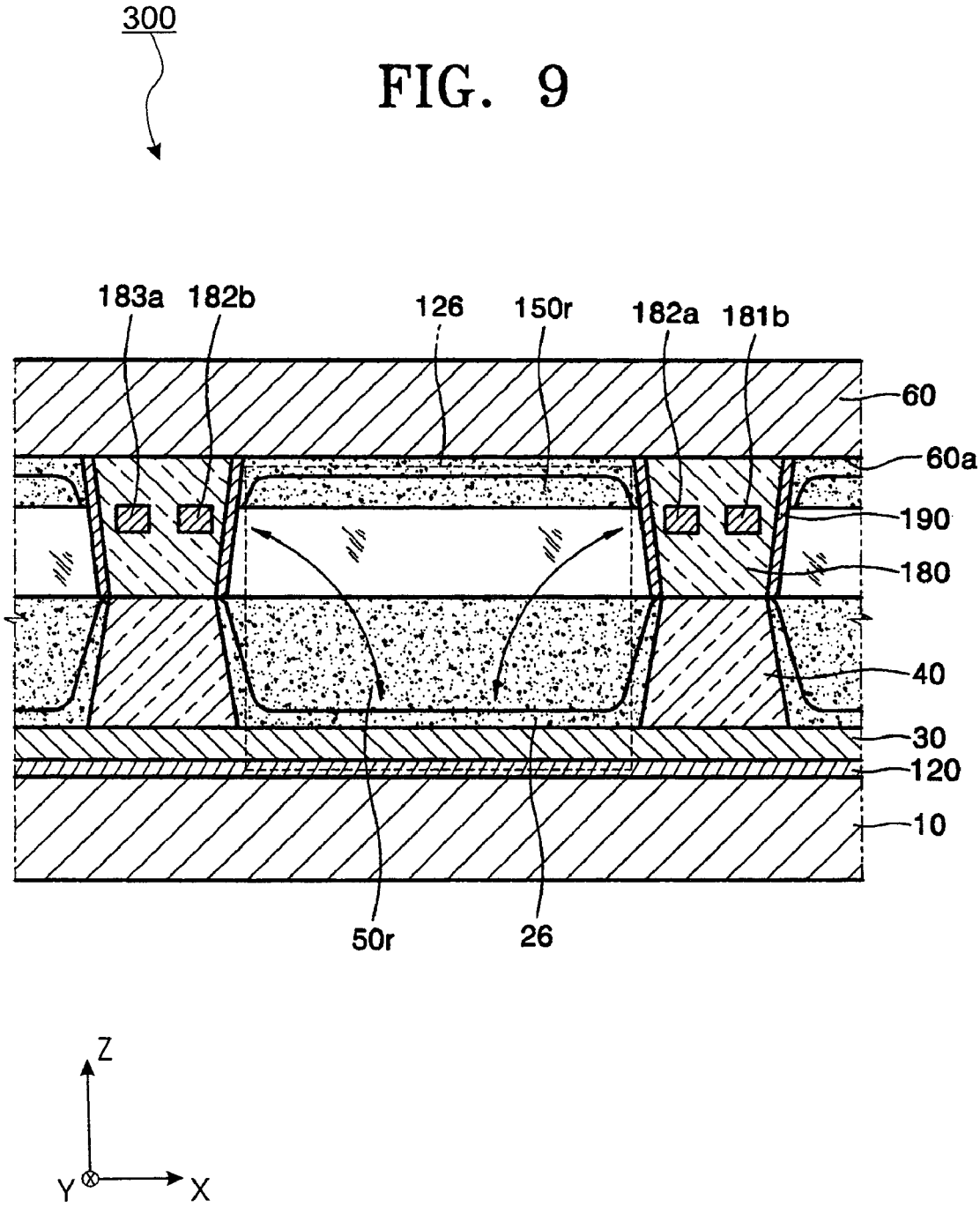

Turning now to FIGS. 8 and 9, FIGS. 8 and 9 are cross-sectional views of a PDP 300 according to a third embodiment of the present invention. Referring to FIGS. 8 and 9, phosphor layers 50*r*, 50*g*, and 50*b* can be formed on side surfaces of the lower barrier ribs 40 and on an upper surface of the dielectric layer 30 as in the second embodiment. In addition, phosphor layers 150*r*, 150*g* and 150*b* can also be formed on a lower surface 60*a* of the upper substrate 60 and on a portion of the upper barrier ribs 180 as in the first embodiment. In this manner, the total surface area of the phosphor layers 50*r*, 50*g*, 50*b*, 150*r*, 150*g*, and 150*b* is increased, thus improving brightness of the PDP 300.

According to the PDPs according to the embodiments of the present invention, the breakdown voltage is reduced when compared to the PDP 100 of FIG. 1 since the sustain discharge occurs at 90°. Also, according to the present invention, the path of visible light is not interrupted by the discharge electrodes since the discharge electrodes are located in the barrier ribs. Therefore, an opening ratio is remarkably improved when compared to PDP 110 of FIG. 1, thus improving the brightness of the PDP. Also, in the present invention, the discharge volume is increased since a discharge occurs in four directions along the barrier ribs of each unit discharge cell. Therefore, the amount of visible light generated in the PDPs according to the present invention is increased when compared to PDP 110 of FIG. 1.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel (PDP), comprising:

a upper substrate;

a lower substrate arranged parallel to the upper substrate;

a first discharge electrode arranged on the lower substrate and extending in a first direction;

a dielectric layer arranged over the first discharge electrode;

a plurality of barrier ribs arranged on dielectric layer and dividing a space between the upper substrate and the lower substrate into a plurality of discharge cells;

a second discharge electrode arranged within the barrier ribs and extending in a second and different direction that crosses the first discharge electrode;

a phosphor layer arranged within the discharge cells; and a discharge gas arranged within the discharge cells.

2. The PDP of claim 1, the barrier ribs comprise:

upper barrier ribs arranged on a lower surface of the upper substrate, the second discharge electrodes being arranged within the upper barrier ribs and not within the lower barrier ribs; and lower barrier ribs arranged on the dielectric layer, the phosphor layer being arranged on sidewalls of the lower barrier ribs and not on the upper barrier ribs.

3. The PDP of claim 1, the second discharge electrodes being of a ladder shape.

4. The PDP of claim 1, the second discharge electrodes being arranged at a distance apart from each other and parallel to each other on an entire surface of the PDP where discharge cells are arranged.

5. The PDP of claim 2, the lower barrier ribs and the upper barrier ribs both being arranged in identical closed patterns.

6. The PDP of claim 2, the phosphor layer being arranged on side surfaces of the lower barrier ribs and on an upper surface of the dielectric layer.

7. The PDP of claim 2, the phosphor layer being arranged on a lower surface of the upper substrate and on a portion of the upper barrier ribs above the second discharge electrode.

8. The PDP of claim 2, the phosphor layer being arranged on a lower surface of the upper substrate and on a portion of the upper barrier ribs above the second discharge electrode, the fluorescent layer being further arranged on the dielectric layer and on the lower barrier ribs below the second discharge electrode.

9. The PDP of claim 1, the first discharge electrode extending in a length direction of the discharge cells and being arranged under a center of discharge cells.

10. The PDP of claim 1, portion of a side surface of a barrier rib not covered by the phosphor layer being covered by an MgO film.

11. The PDP of claim 1, the dielectric layer being highly reflective to visible light.

12. The PDP of claim 1, a sustain discharge originating from all four sides of each discharge cell.

13. The PDP of claim 1, the phosphor layer being arranged within a portion of the discharge cells away from the second discharge electrode.

14. The PDP of claim 1, the barrier ribs extending in a first direction and in a second direction, two strands of the second discharge electrode being present in portions of the barrier ribs extending in the second direction and only one strand of the second discharge electrode being present in portions of the barrier rib extending in the first direction.

15. The PDP of claim 1, the second discharge electrode being adapted to perform a scanning function and a sustain discharge function and the first discharge electrode being adapted to perform an address function and the sustain discharge function.

16. The PDP of claim 1, wherein a sustain discharge occurs between the first discharge electrode and the second discharge electrode.

17. The PDP of claim 1, the plurality of barrier ribs extending in two directions that are orthogonal to each other and producing a lattice pattern.

18. The PDP of claim 1, ones of the plurality of discharge cells being rectangular in shape.

19. The PDP of claim 3, the second discharge electrode comprises rung portions and side portions that together produce the ladder shape.

20. The PDP of claim 1, the second discharge electrode being arranged only in between adjoining ones of the plurality of discharge cells.

* * * * *